US010117537B2

(12) United States Patent
Watson

(10) Patent No.: US 10,117,537 B2
(45) Date of Patent: Nov. 6, 2018

(54) CHRISTMAS TREE STAND

(71) Applicant: Martin Watson, Chelmsford (GB)

(72) Inventor: Martin Watson, Chelmsford (GB)

( * ) Notice: Subject to any disclaimer, the term of this patent is extended or adjusted under 35 U.S.C. 154(b) by 0 days.

(21) Appl. No.: 15/541,723

(22) PCT Filed: Jan. 6, 2016

(86) PCT No.: PCT/GB2016/050016
§ 371 (c)(1),
(2) Date: Jul. 6, 2017

(87) PCT Pub. No.: WO2016/110692
PCT Pub. Date: Jul. 14, 2016

(65) Prior Publication Data

US 2018/0008077 A1 Jan. 11, 2018

(30) Foreign Application Priority Data

Jan. 8, 2015 (GB) ..... 1500241.3

(51) Int. Cl.
*A47G 33/12* (2006.01)
*E04H 12/22* (2006.01)

(52) U.S. Cl.
CPC ..... *A47G 33/1206* (2013.01); *E04H 12/2238* (2013.01); *E04H 12/2246* (2013.01); *A47G 2033/1286* (2013.01)

(58) Field of Classification Search
CPC .... A47G 33/12; A47G 33/1206; F16M 11/32; E04H 12/2238; E04H 12/2246; E04H 12/22
USPC ..... 248/163.1, 431, 435, 168, 440.1, 188.7, 248/188.8, 188.6, 158, 418, 524, 519, 248/521, 525, 526, 523, 528, 588, 169, 248/177, 166; 47/40.5, 175, 511
See application file for complete search history.

(56) References Cited

U.S. PATENT DOCUMENTS 1,110,142 A * 9/1914 Piner ..... 248/174
1,496,272 A * 6/1924 Jutz, Sr. ..... A47G 33/12 160/DIG. 12
1,769,127 A * 7/1930 Finnegan ..... A47G 33/12 248/524
1,770,853 A 7/1930 Johnson
1,971,300 A * 8/1934 Garrett ..... A47G 33/126 248/522

(Continued)

FOREIGN PATENT DOCUMENTS

DE 2638332 A1 3/1978
DE 2002215 U1 3/2001

*Primary Examiner* — Nkeisha Smith
(74) *Attorney, Agent, or Firm* — Crose Law LLC; Bradley D. Crose

(57) ABSTRACT

Many forms of Christmas tree stand, for use with real (i.e. cut) Christmas trees are known, such as those that may be filled with water to prolong the life of the tree. The present invention relates to a Christmas tree stand, and a method of maintaining a Christmas tree in a substantially upright position, and includes a reservoir 3 with retaining parts 9 at upper and lower ends thereof, and an outer container into which the reservoir is configured to be securable, the container configured to substantially conceal the reservoir and having a base larger than the reservoir. This prevents damage to floor surfaces (such as carpets and tiles) and prevents accidental contact by passers-by with difficult-to-see legs and/or arms.

6 Claims, 2 Drawing Sheets

(56) References Cited

U.S. PATENT DOCUMENTS 2,750,138 A 6/1956 Morris
3,116,096 A 12/1963 Kavanagh
4,884,363 A * 12/1989 Sofy ..... A47G 33/12 248/527
5,000,414 A * 3/1991 Rosato ..... A47G 33/12 248/524
5,074,514 A * 12/1991 Smith ..... A47G 33/12 248/188.7
5,388,799 A * 2/1995 Keefe ..... A47G 33/12 248/129
5,482,245 A 1/1996 Graves
5,484,131 A * 1/1996 Aldrete ..... A47G 33/1226 248/515
5,893,547 A * 4/1999 Cohen, Jr. ..... F16M 11/08 248/521
6,681,519 B2 * 1/2004 Cone ..... A47G 33/1206 248/519
6,702,086 B2 3/2004 Ries-Mueller et al.
8,166,702 B1 * 5/2012 Laface ..... A47G 33/12 47/40.5
9,657,491 B1 * 5/2017 Mansueto ..... E04H 12/2238
2003/0084607 A1 * 5/2003 Cone ..... A47G 33/1206 47/40.5
2005/0133683 A1 * 6/2005 Welzen ..... A47G 33/1226 248/523
2009/0193713 A1 * 8/2009 Limber ..... A47G 33/12 47/40.5
2011/0141740 A1 * 6/2011 Scollan ..... A47G 33/12 362/249.18
2015/0223404 A1 8/2015 Riley
2015/0223405 A1 * 8/2015 Riley ..... A01G 9/02 47/65.7
2016/0186456 A1 * 6/2016 Mansueto ..... E04H 12/2269 248/523

* cited by examiner

CHRISTMAS TREE STAND

The present invention relates generally to a Christmas tree stand and a method of maintaining a Christmas tree in a substantially upright position.

Many forms of Christmas tree stand, for use with real (i.e. cut) Christmas trees are known, such as those that may be filled with water to prolong the life of the tree. The present invention seeks to overcome some of the limitations found in the prior art.

According to a first aspect of the present invention, there is provided a Christmas tree stand, comprising: an open-top water reservoir comprising a first tree-retention part at a lower end thereof, and a second tree-retention part at an upper end thereof, the open-top water reservoir configured for a lower end of a trunk of a Christmas tree to be inserted therein and secured by means of the first and second tree-retention parts; an outer container into which the open-top water reservoir is configured to be securable, the outer container comprises a flat-pack structure, assemblable from a plurality of flat panel side panels, a flat panel upper surface panel and a flat panel base with a surface area at least 30% larger than a surface area of the lower end of the open-top water reservoir; grooves being provided on the flat panel upper surface panel and the flat panel base for insertion of the plurality of flat panel side panels therein, and further grooves being provided on the plurality of flat panel side panels for connecting the plurality of flat panel side panels together, such that the plurality of flat panel side panels, the flat panel upper surface panel and the flat panel base slot together.

In this way, unattractive, robust and purely functional water reservoirs may be substantially hidden by larger, ornate outer containers. In particular, the outer container may be substantially convex; that is, substantially free of concave portions, projections and/or protrusions that are undesirable. In one arrangement, the outer container may be substantially a cube or cuboid shape; however, other shapes are also envisaged. This prevents damage to floor surfaces (such as carpets and tiles) and prevents accidental contact by passers-by with difficult-to-see legs and/or arms.

The flat panel base of the outer container may have a surface area at least 200%, 300%, 400%, 430%, 450%, 500% or 600% larger than a surface area of the lower end of the open-top water reservoir. In particular, the interior of the water reservoir may have a lateral extent (e.g. diameter) of between approximately 11 and 18 cm, in particular between approximately 13 and 16 cm, more particularly approximately 14 cm. The flat panel base of the outer container may have a lateral extent (e.g. width) of between approximately 25 and 50 cm, in particular between approximately 30 and 40 cm, more particularly between approximately 34 and 35 cm.

In some embodiments, the flat panel base of the outer container may be square and the water reservoir may be substantially cylindrical; however, other shapes are envisaged. In particular, the outer container may be substantially cube shaped; however, it could equally be another form of square prism.

The open-top water reservoir may be configured to be removably securable into the outer container. In this way, the reservoir may be removed for easy cleaning within an ordinary domestic sink. In particular, the reservoir may be insertable through a corresponding hole in an upper surface of the outer container. The reservoir may include a collar around an upper periphery thereof to prevent over-insertion of the reservoir into the outer container. The outer container may further comprise a socket for receiving and holding the reservoir therein, wherein the socket may be located on an interior surface of the flat panel base of the outer container. In this way, the reservoir may be held at an upper end and a lower end by the outer container, for stability.

The outer container may be configured to substantially conceal the open-top water reservoir when in use.

The outer container may be 'flat pack'. The outer container may comprise a plurality of such panels each including coupling means along corresponding peripheries thereof, such that the panels may be hold themselves together to form the outer container. Alternatively or additionally, each panel may be coupled to an adjacent panel by means of a connecting member. The flat panel upper surface panel may comprise a top and/or the flat panel base may comprise a base, and each may be moulded from a plastics material. The plurality of flat panel side panels may comprise side panels and may comprise a corrugated plastics material sheet, which may also comprise a moulded plastic layer to provide a consistent exterior appearance with the top. The coupling means may comprise a groove (e.g. integrated in the panel). The outer container may also comprise corner pieces for coupling three adjacent panels together at a corner. Reinforcing ribs may be formed on the top and/or base (and in some embodiments on the side panels) to increase structural rigidity of the outer container. The reinforcing ribs may be supplemented, or replaced, by anchoring panels for the same purpose. Such anchoring panels may connect one or more of the side panels with the base and/or top, and/or an exterior surface of the reservoir.

The outer container may comprise at least one aperture for passing a lighting cable therethrough. In some embodiments, the outer container may include a plurality of such apertures (potentially of different dimensions) so that lighting cables may be run through the outer container. In this way, unsightly cables, plugs, extension leads and/or splitters may also be concealed within the outer container. Further, the outer container will act to protect these electrical connection components from water that may accidentally be spilled when the reservoir is filled and/or topped up.

The Christmas tree stand may further comprise a reservoir insert configured to be removably insertable into the open-top water reservoir and, when inserted, configured to support the lower end of the trunk of the Christmas tree thereon. The reservoir insert may comprise a third tree-retention part at an upper end thereof, and may comprise a cylindrical spacer configured to fit snugly inside the reservoir for spacing the third tree-retention part from the first tree-retention part (when in use). The Christmas tree stand may be configured for a lower end of the trunk of the Christmas tree to be secured by means of the second and third tree-retention parts. In this way, trees with differing lengths of trunk may be secured within the stand without the need to remove the lowermost branches.

The first tree-retention part may be a spike (e.g. of inverted cone shape) or a plurality of spikes (e.g. two, three, four or five spikes), which may be centrally and/or symmetrically located within the bottom of the reservoir. The second tree-retention part may be a clamp or a plurality of clamps disposed symmetrically about the top (e.g. around the collar) of the reservoir. The third tree-retention part may be substantially the same as the first tree-retention part, and the support may be a spacer, for instance having a profile that fits snugly within the reservoir.

The reservoir and reservoir inset may be, for instance, cast from metal or may be formed from a plastics material.

According to a second aspect of the present invention, there is provided a method of maintaining a Christmas tree in a substantially upright position, the method comprising the steps of: providing a Christmas tree stand according with the first aspect; assembling the outer container from the plurality of flat panel side panels, the flat panel upper surface panel, and the flat panel base; inserting a lower end of a trunk of the Christmas tree into the open-top water reservoir; and securing the Christmas tree in the open-top water reservoir by means of the first and second tree-retention parts.

The method may further comprise steps for assembling the Christmas tree stand selected from the following: providing the flat panel base, slotting plurality of flat panel side panels into grooves in the flat panel base, coupling (e.g. slotting) adjacent ones of the plurality of flat panel side panels together, coupling corner pieces onto the flat panel base and/or plurality of flat panel side panels, coupling the flat panel upper surface panel onto the plurality of flat panel side panels for instance by inserting the plurality of flat panel side panels into grooves on the flat panel upper surface panel, inserting the reservoir through the hole on the flat panel upper surface panel until the lower portion of the reservoir rests in a recess in the flat panel base and the collar of the reservoir rests on the flat panel upper surface panel.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

Figure 1:
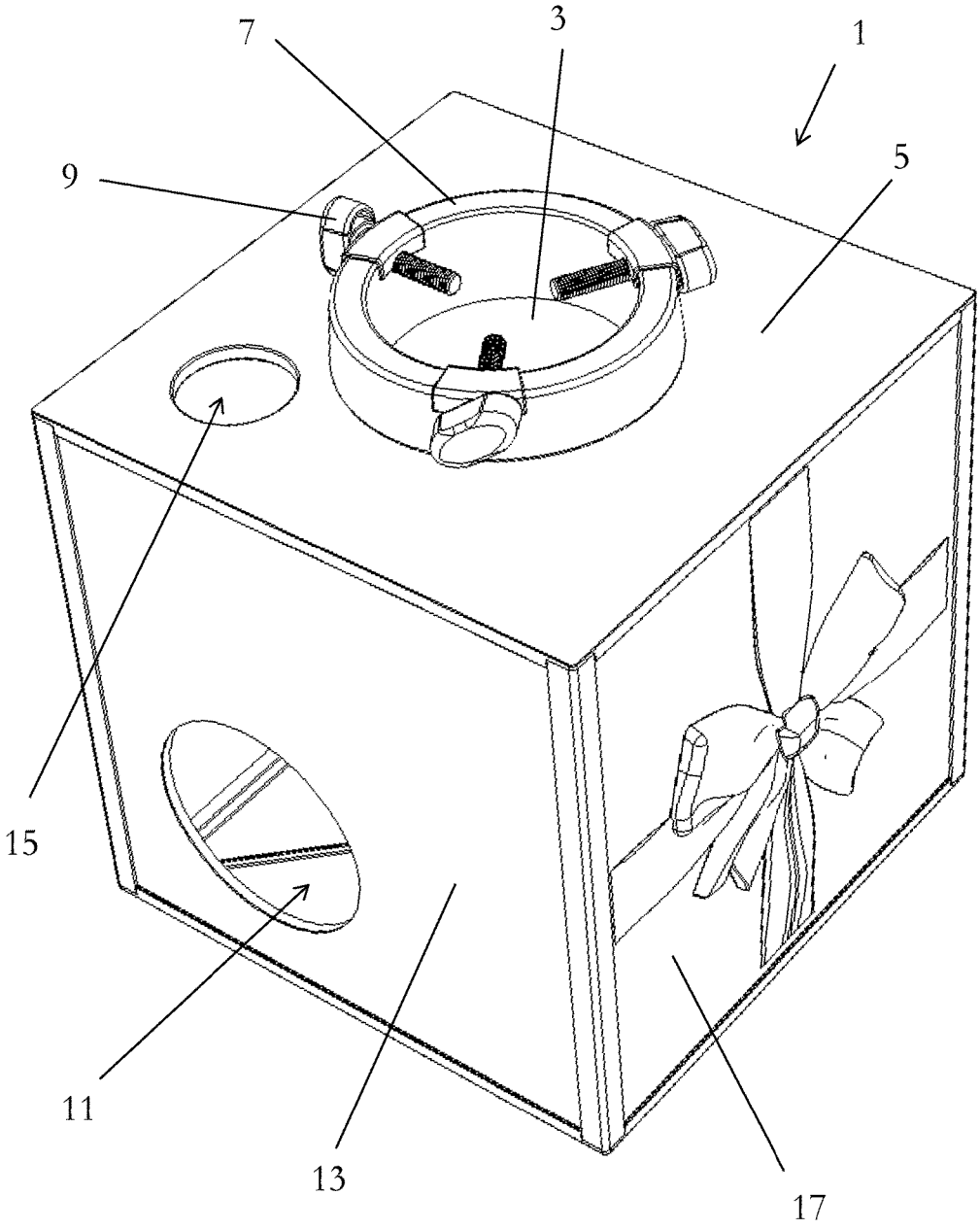
FIG. 1 is an exterior perspective view of a stand in accordance with the first aspect of the invention.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

FIG. 1 shows an exterior perspective view of a stand 1 having a substantially cylindrical reservoir 3 inserted within a hole (not shown) within an upper surface 5 of a cube-shape outer container. The reservoir 3 includes a collar 7, which has a diameter larger than the hole (not shown) within the upper surface 5, such that the collar 7 rests on the upper surface 5. Three screw-thread clamping members 9 are provided symmetrically disposed around the collar to grip the lower portion of a trunk of a Christmas tree. In some embodiments the clamping members 9 may have sharp and/or pointed ends to grip the trunk; however, in the arrangement shown the members 9 have flat ends similar to bolts.

A circular hole 11 in the rear face 13 of the container allows electrical cables to be fed into the container, and a further circular hole 15 of smaller diameter in the upper surface 5 allows the lighting cables to be run out to the tree, for lighting purposes. The remaining faces 17 of the container are decorated to look like a present, so that they blend in with the surroundings.

Figure 2:
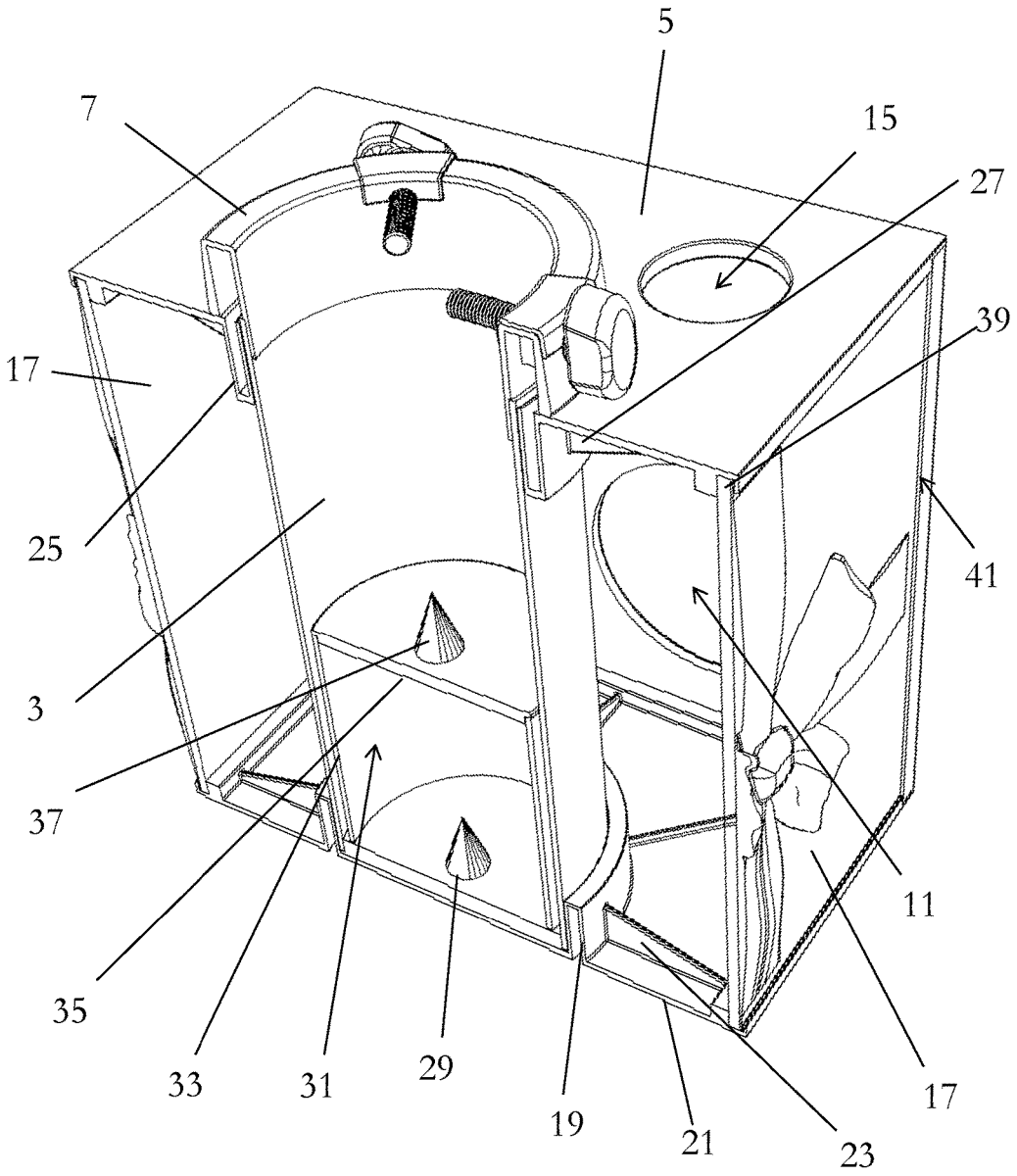
FIG. 2 is a cross-sectional view of the stand shown in FIG. 1.

FIG. 2 is a cross-sectional view of the stand shown in FIG. 1, viewed from the opposite side. The reservoir 3 can be seen inserted into a socket 19 in the interior of the base 21 of the container. The socket 19 is supported by reinforcing ribs 23. A flange 25 extends around the hole in the upper surface 5 upon which the collar 7 rests. The flange 25 is also supported by corresponding reinforcing ribs 27.

Inside the reservoir 3 is provided a spike 29 located centrally in the bottom, onto which a trunk of a tree may be placed. The spike 29 is configured to push into the trunk to prevent lateral movement thereof relative to the reservoir 3. The reservoir is water tight and may be filled with water once the tree has been inserted.

Also shown inside the reservoir is a removable insert 31 comprising a cylindrical spacer 33 configured to fit snugly inside the reservoir 3, a upper plate 35, and a second spike 37 centrally located on the upper plate 35. The function of the second spike 37 is identical to the spike 29, but for use with trees having shorter trunks.

Grooves 39 are provided in the upper surface 5 and the base 21 for insertion of the rear face 13 and the side faces 17 therein. Similar grooves 41 are provided for connecting the side faces 17 and the rear panel 13 together.

There is provided sufficient space within the outer container to house electrical connectors, extension blocks, plugs, lighting controls, etc, protected from water and dropped pine needles.

The invention claimed is:

1. A Christmas tree stand, comprising:

an open-top water reservoir comprising a first tree-retention part at a lower end thereof, and a second tree-retention part at an upper end thereof, the open-top water reservoir configured for a lower end of a trunk of a Christmas tree to be inserted therein and secured by means of the first and second tree-retention parts;

an outer container into which the open-top water reservoir is configured to be securable, the outer container comprises a flat-pack structure assemblable from a plurality of flat panel side panels, a flat panel upper surface panel and a flat panel base with a surface area at least 30% larger than a surface area of the lower end of the open-top water reservoir; grooves being provided on the flat panel upper surface panel and the flat panel base for insertion of the plurality of flat panel side panels therein, and further grooves being provided on the plurality of flat panel side panels for connecting the plurality of flat panel side panels together, such that the plurality of flat panel side panels, the flat panel upper surface panel and the flat panel base slot together.

2. The Christmas tree stand of claim 1, wherein the flat panel base of the outer container has a surface area at least 400% larger than a surface area of the lower end of the open-top water reservoir.

3. The Christmas tree stand of claim 1, wherein the open-top water reservoir is configured to be removably securable into the outer container.

4. The Christmas tree stand of claim 1, wherein the outer container comprises at least one aperture for passing a lighting cable therethrough.

5. The Christmas tree stand of claim 1, further comprising a reservoir insert configured to be removably insertable into the open-top water reservoir and, when inserted, configured to support the lower end of the trunk of the Christmas tree thereon, the reservoir insert comprising a third tree-retention part at an upper end thereof, and a cylindrical spacer configured to fit snugly inside the open-top water reservoir for spacing the third tree-retention part from the first tree-retention part, the Christmas tree stand configured for a lower end of the trunk of the Christmas tree to be secured by means of the second and third tree-retention parts, where the first and third tree-retention parts are spikes and the second tree-retention part is a plurality of clamps.

6. A method of maintaining a Christmas tree in a substantially upright position, the method comprising the steps of:

providing the Christmas tree stand according to claim 1;

assembling the outer container from the plurality of flat panel side panels, the flat panel upper surface panel, and the flat panel base;

inserting the lower end of the trunk of the Christmas tree into the open-top water reservoir; and securing the Christmas tree in the open-top water reservoir by means of the first and second tree-retention parts.

* * * * *